United States Patent [19]

Gallo

[11] 4,080,545

[45] Mar. 21, 1978

[54] SODIUM VAPOR LAMP WITH EMISSION APERTURE

[75] Inventor: Charles F. Gallo, Penfield, NY

[73] Assignee: Xerox Corporation, Stamford, Conn.

[21] Appl. No.: 754,782

[22] Filed: Dec. 27, 1976

[51] Int. Cl.[2] ..... H01J 61/35; H01J 61/22; H01J 61/52; H01J 61/40

[52] U.S. Cl. ..... 313/15; 313/111; 313/113; 313/220; 313/227

[58] Field of Search ..... 313/34, 15, 227, 113, 313/111, 220

[56] References Cited

U.S. PATENT DOCUMENTS

| | | | |
|---|---|---|---|
| 3,221,198 | 11/1965 | Van der Wal et al. | 313/113 X |
| 3,283,202 | 11/1966 | Pennington | 313/113 X |
| 3,646,378 | 2/1972 | Goossens | 313/220 X |
| 3,779,640 | 12/1973 | Kidd | 313/15 X |
| 3,995,182 | 11/1976 | Balder et al. | 313/113 |

FOREIGN PATENT DOCUMENTS

| | | | |
|---|---|---|---|
| 987,939 | 3/1965 | United Kingdom | 313/220 |

*Primary Examiner*—Palmer C. Demeo

[57] ABSTRACT

Various sodium vapor lamp configurations are disclosed. In one, a sodium vapor discharge tube contains an excess of sodium which is condensed in predetermined locations, as for example dimples. To prevent condensation in the aperture through which light emission is desired, the discharge tube is heated at the aperture by ohmic heating of a conductive film such as tin oxide or by fine wires. In a second configuration, the discharge tube is coated on the inside with metallic sodium, the coating being internally reflective and defining an aperture, such as a slit, through which light output is directed. The aperture area is coated with a conductive coating such as tin oxide to provide ohmic heating of the aperture area so that metallic sodium condenses on the tube in areas other than the aperture. Thus, an excess of sodium is provided to control the lamp vapor pressure and also to form a light reflective coating to direct emission through the aperture.

6 Claims, 2 Drawing Figures

SODIUM VAPOR LAMP WITH EMISSION APERTURE

BACKGROUND OF THE INVENTION

This invention relates to sodium vapor lamps and in particular to a low pressure sodium vapor lamp in which the discharge tube is partially coated with metallic sodium to form an opaque-reflective tube inner surface which in turn defines an aperture through which light output is directed. This aperture area is coated with a conductive coating, transparent in the visible spectrum, to provide ohmic heating of the aperture to avoid sodium condensation thereon.

Low pressure sodium vapor lamps have several desirable properties for application as exposure lamps in xerographic photocopiers. The spectral output of sodium lamps is almost monochromatic, emitting essentially at 589.0 and 589.6 nanometers, this in the yellow portion of the spectrum. As has been pointed out in U.S. Pat. No. 3,869,205, this yellow radiation is particularly desirable for creating object contrast for copying of most documents and paper work in general use. Furthermore, the efficiency of low pressure sodium lamps is relatively high and compares favorably with other linear light sources.

For xerographic application, there are certain characteristics of sodium lamps that present problems to be overcome. Excess metallic sodium is generally present within the lamp discharge tube to control the vapor pressure within the tube. This metallic sodium is opaque and absorbs some of the radiation from the sodium vapor discharge and to that extent lowers the lamp efficiency. Also, for most xerographic applications, it is desirable to focus the light emission from the exposure lamps onto a rectangular slit to minimize lost light.

In the prior art, as for example U.S. Pat. No. 3,221,198 to Van der Wal et al, the coating of a sodium vapor lamp tube with tin oxide for the purpose of visible transmission and infrared reflection, this in turn for the purpose of heat conservation is known.

It is an object of the present invention to provide a sodium vapor discharge lamp with a combination of a reflective coating of excess sodium defining a light aperture to provide desired directionality of visible light emission.

SUMMARY OF THE INVENTION

This invention is practiced in one form by a sodium vapor lamp including a sodium vapor discharge tube. The discharge tube contains an excess of metallic sodium. An aperture area through which light emission is desired is coated with a conductive coating such as tin oxide to provide ohmic heating of the aperture area so that metallic sodium condenses on the tube in areas other than the aperture. Thus, an excess of sodium is provided to control the lamp vapor pressure and also to form a light reflective coating to direct emission through the aperture. In the alternative, fine wires at the aperture provide the ohmic heating of the aperture area.

For a better understanding of this invention, reference is made to the following detailed description of an exemplary embodiment, given in connection with the accompanying drawing.

DRAWING

DESCRIPTION

Figure 1:
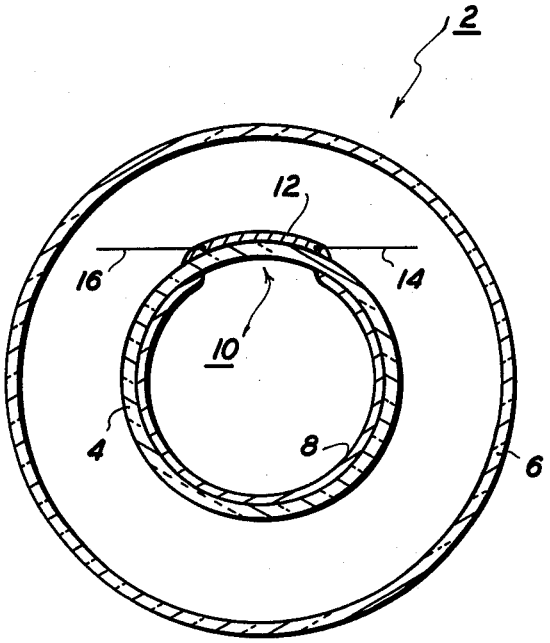
FIG. 1 is a schematic cross section of a sodium vapor lamp tube according to a particular embodiment of the present invention.

Referring to FIG. 1, a sodium vapor discharge lamp is generally indicated in cross section at 2 and includes an inner discharge tube 4 within an outer transparent envelope 6. The glass inner discharge tube 4 is coated on its inside with metallic sodium, represented at 8, the coating extending around most but not all of the interior wall of the tube to define a clear aperture 10 thereon. On the exterior of the tube, and corresponding to the aperture 10, is a coating 12 of an electrically conductive, light transmitting material. Tin oxide is one such material and is presently preferred. Conductive coating 12 is electrically connected to a source of electrical current, schematically represented by connectons 14 and 16 which may or may not be a part of the lamp power circuit.

In operation, the sodium discharge lamp 2 functions in a known way to emit light in the inner discharge tube 4 by the passage through vaporized sodium of an electric discharge. The coating 8 of an excess of metallic sodium on the walls of the tube 4, functions to control the vapor pressure within the discharge tube. This concept per se is well known in the prior art in which excess sodium is provided in reservoirs such as dimples where the condensed sodium collects. In the present environment however, this excess sodium performs the additional function of providing an opaque film which is highly reflective in both visible and infrared wave lengths. The sodium layer 8 furthermore defines an aperture 10 for the desired narrow slit light emission.

Since metallic sodium will condense at the coolest part of the discharge tube 4, the temperature at the aperture 10 is kept elevated relative to that of the rest of the tube 4 by means of the conductive coating 12. An electric current is passed through coating 12 which provides ohmic heating to the adjacent aperture 10, necessitating that sodium condensation occurs in the remaining area around the inside of tube 4.

The tin oxide coating 12 is transmissive of visible radiation and reflective of infrared radiation. Thus, the combination of sodium coating at 8 and tin oxide coating at 12 provides infrared reflection around the entire circumference of the tube 4 and visible transmission only at aperture 10.

Figure 2:
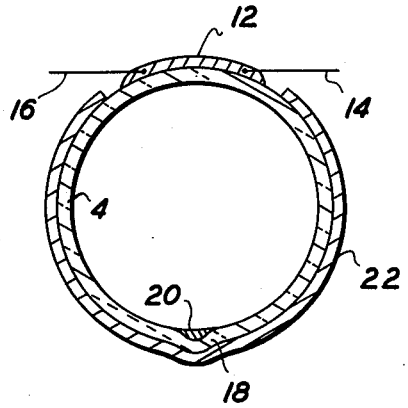
FIG. 2 is a schemactic cross section of a more general embodiment of this invention.

Referring now to FIG. 2, a sodium vapor discharge tube is again shown at 4 and is coated with a conductive coating 12 operatively connected to a source of electrical current by connections 14 and 16. In this case, tube 4 includes a plurality of dimples 18 which act as reservoirs for condensed excess sodium 20. FIG. 2 represents the general case of this invention since the dimples per se are known to the prior art. An outer envelope, such as 6 in FIG. 1, may or may not be included. It is not included in FIG. 2 and in this configuration a reflecting film 22 is coated on the discharge tube to provide the desired directionality of light emission. If an outer envelope 6 is included, reflecting film 22 may be coated on it instead of on the discharge tube 4.

While tin oxide is presently preferred as a material for the coating 12, other materials may be used such as fine wires to provide the desired ohmic heating.

The foregoing description of certain embodiments of this invention is given by way of illustration and not of limitation. The concept and scope of the invention are limited only by the following claims and equivalents thereof which may occur to others skilled in the art.

What is claimed is:

1. A sodium vapor discharge lamp comprising an inner discharge tube within an outer transparent envelope, said inner discharge tube having on the inner surface thereof a reflective coating of metallic sodium defining an aperture for the transmission of visible light, said coating of metallic sodium providing a reserve of metallic sodium and a reflector for infrared and visible radiation, and a conductive and light-transmissive coating on said discharge tube substantially coextensive with said aperture operatively connected to a source of electrical current and effective to add ohmic heating to said aperture to prevent condensation of sodium thereon.

2. A sodium vapor discharge lamp as defined in claim 1 in which said conductive and light-transmissive coating is on the exterior of said discharge tube and is composed of tin oxide.

3. A sodium vapor discharge lamp including a sodium vapor discharge tube, said discharge tube having on the inner surface thereof a reflective coating of metallic sodium, effecting an integrating cavity for infrared and visible radiation within said discharge tube and defining an aperture for the transmission of visible radiation from said discharge tube in a desired direction, and a conductive and light-transmissive coating on said discharge tube substantially coextensive with said aperture operatively connected to a source of electrical current and effective to add ohmic heating to said aperture to prevent condensation of sodium thereon, said light-transmissive coating being reflective of infrared radiation.

4. A sodium vapor discharge lamp as defined in claim 3 in which said conductive and light-transmissive coating is disposed on the outer surface of said discharge tube and is composed of tin oxide.

5. A sodium vapor discharge lamp including a sodium vapor discharge tube, said discharge tube containing an excess of metallic sodium, a reflective coating on said discharge tube defining an aperture for the transmission of visible radiation from said discharge tube in a desired direction, and a conductive and light-transmissive coating on said discharge tube substantially coextensive with said aperture operatively connected to a source of electrical current and effective to add ohmic heating to said aperture to prevent condensation of sodium thereon, said light-transmissive coating being reflective of infrared radiation.

6. A sodium vapor discharge lamp as defined in claim 5 in which said conductive and light-transmissive coating is disposed on the outer surface of said discharge tube and is composed of tin oxide.

* * * * *